US005134010A

United States Patent [19]

Schiel

[11] Patent Number: 5,134,010

[45] Date of Patent: Jul. 28, 1992

[54] REINFORCED PRESS JACKET FOR A PRESS UNIT FOR THE TREATMENT OF WEB-LIKE MATERIAL, SUCH AS PAPER WEBS

[75] Inventor: Christian Schiel, Heidenheim, Fed. Rep. of Germany

[73] Assignee: J. M. Voith GmbH, Fed. Rep. of Germany

[21] Appl. No.: 299,829

[22] PCT Filed: May 6, 1988

[86] PCT No.: PCT/EP88/00386

§ 371 Date: Jan. 5, 1989

§ 102(e) Date: Jan. 5, 1989

[87] PCT Pub. No.: WO88/08897

PCT Pub. Date: Nov. 17, 1988

[30] Foreign Application Priority Data

May 7, 1987 [DE] Fed. Rep. of Germany ..... 3715153

[51] Int. Cl.[5] ..... D21F 3/00; B65G 15/34; B32B 5/12; B32B 3/28

[52] U.S. Cl. ..... 428/113; 162/901; 198/847; 428/131; 428/137; 428/156; 428/160; 428/167; 428/294; 428/295; 428/298; 428/302; 428/397; 428/399; 428/423.1

[58] Field of Search ..... 428/113, 283, 295, 131, 428/137, 156, 160, 167, 294, 298, 302, 397, 399, 423.1; 162/358; 198/847

[56] References Cited

U.S. PATENT DOCUMENTS

| | | | |
|---|---|---|---|
| 3,498,684 | 3/1970 | Hallaman | 198/847 |
| 4,069,569 | 1/1978 | Meckel et al. . | |
| 4,216,856 | 8/1980 | Moring et al. | 428/113 |
| 4,229,253 | 10/1980 | Cronin | 162/358 |
| 4,238,287 | 12/1980 | Gill | 162/358 |
| 4,482,430 | 11/1984 | Majaniemi | 162/358 |
| 4,559,258 | 12/1985 | Kiuchi | 162/358 |
| 4,880,501 | 11/1989 | Schiel | 162/358 |

FOREIGN PATENT DOCUMENTS 8702080 4/1987 World Int. Prop. O. .

*Primary Examiner*—George F. Lesmes
*Assistant Examiner*—James D. Withers
*Attorney, Agent, or Firm*—Ostrolenk, Faber, Gerb & Soffen

[57] ABSTRACT

An endless flexible press jacket for a press roll, a process for its fabrication and an apparatus upon which it is fabricated. The press jacket comprises a radially inner layer of elastomeric material which is provided with embedded layers of reinforcing yarns, an inner longitudinal layer of yarns extending under tension between the lateral ends of the endless tubular press jacket and a helical winding of peripheral yarns pretensioned and wrapped around the longitudinal yarns. The longitudinal yarns are held pretensioned radially above a casting mandrel and the casting nozzle moves along the axis of the casting mandrel delivering a helix of castable jacket material around the casting mandrel. At the same time, the later peripheral yarns are applied into the longitudinal yarns in the applied jacket material.

18 Claims, 5 Drawing Sheets

FIG. 9
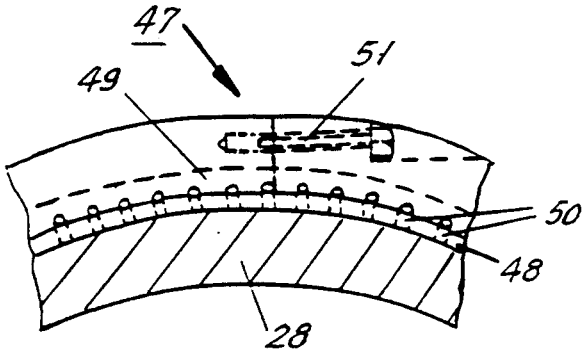
FIG. 3
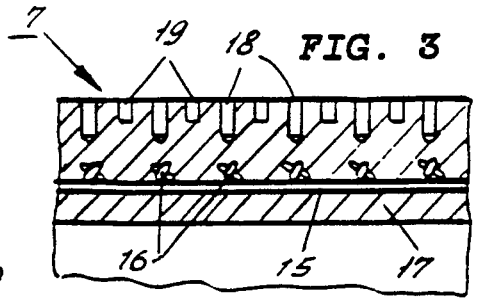
FIG. 8
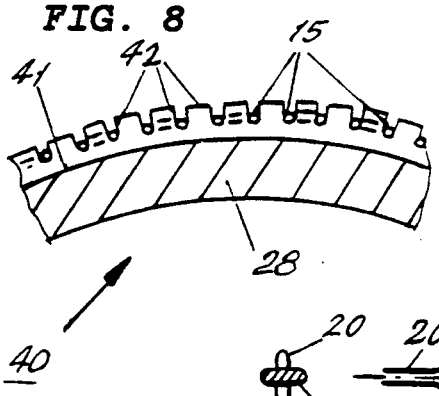
FIG. 11
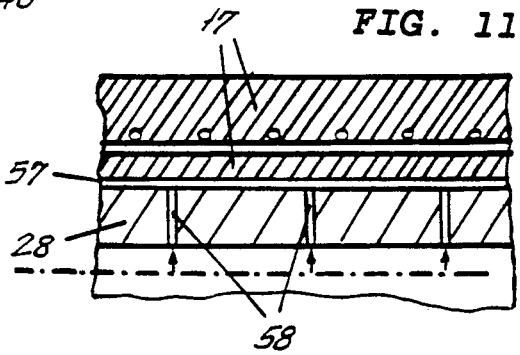
FIG. 4a
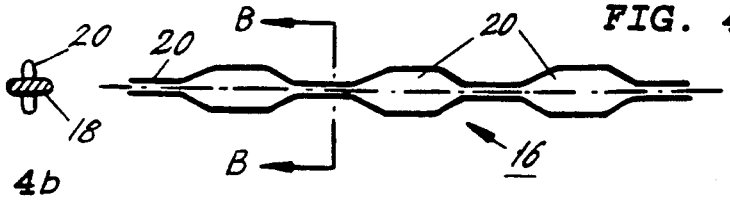
FIG. 4b
FIG. 10a
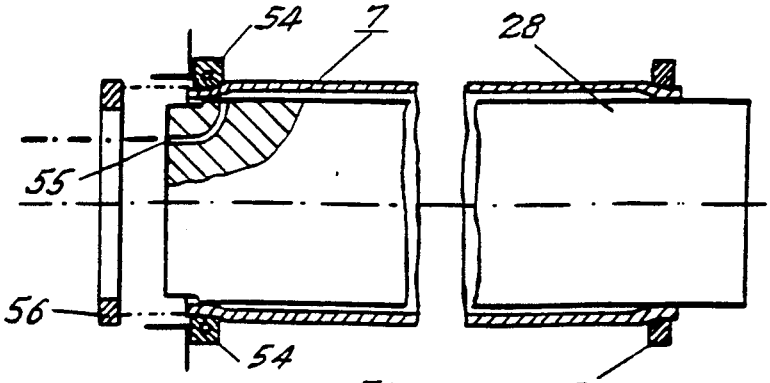
FIG. 10b
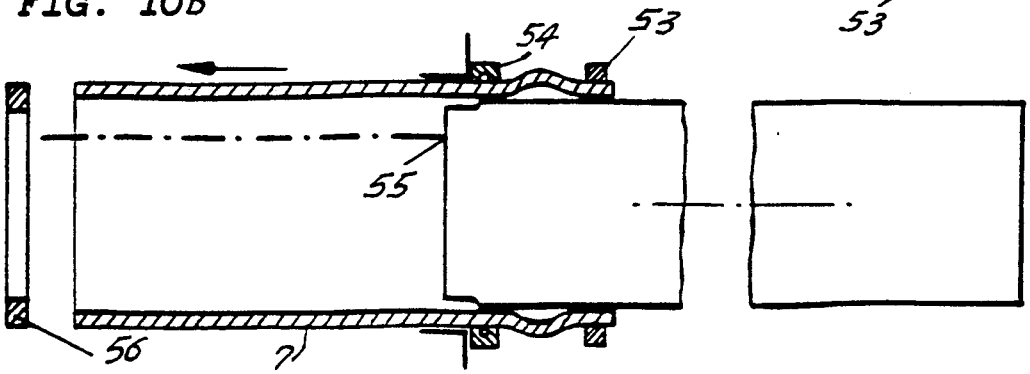

REINFORCED PRESS JACKET FOR A PRESS UNIT FOR THE TREATMENT OF WEB-LIKE MATERIAL, SUCH AS PAPER WEBS

BACKGROUND OF THE INVENTION

The present invention relates to a press jacket (or a press belt) for a press device for the treatment of web-like material, such as paper webs, and particularly relates to the materials of which the jacket is comprised.

The invention relates in addition to a process and a device for the production of such a press jacket.

The preferred field of application of such press jackets is papermaking machines. The said press device with the press jacket may be a so-called extended-nip press, e.g.

according to U.S. Pat. No. 4,238,287 (FIG. 1)
according to U.S. Pat. No. 4,552,620 (FIG. 5)
according to DE-OS 32 35 468 (corresponding to GB 2,106,557 B) (FIG. 1) and
according to VOITH publication "Mehrschichtband" (imprint P 4002 K/0197 K/Sh/Srö - received in the library of the German Patent Office on 26.7.1984)

as known in conjunction with papermaking machines.

Figure 6:
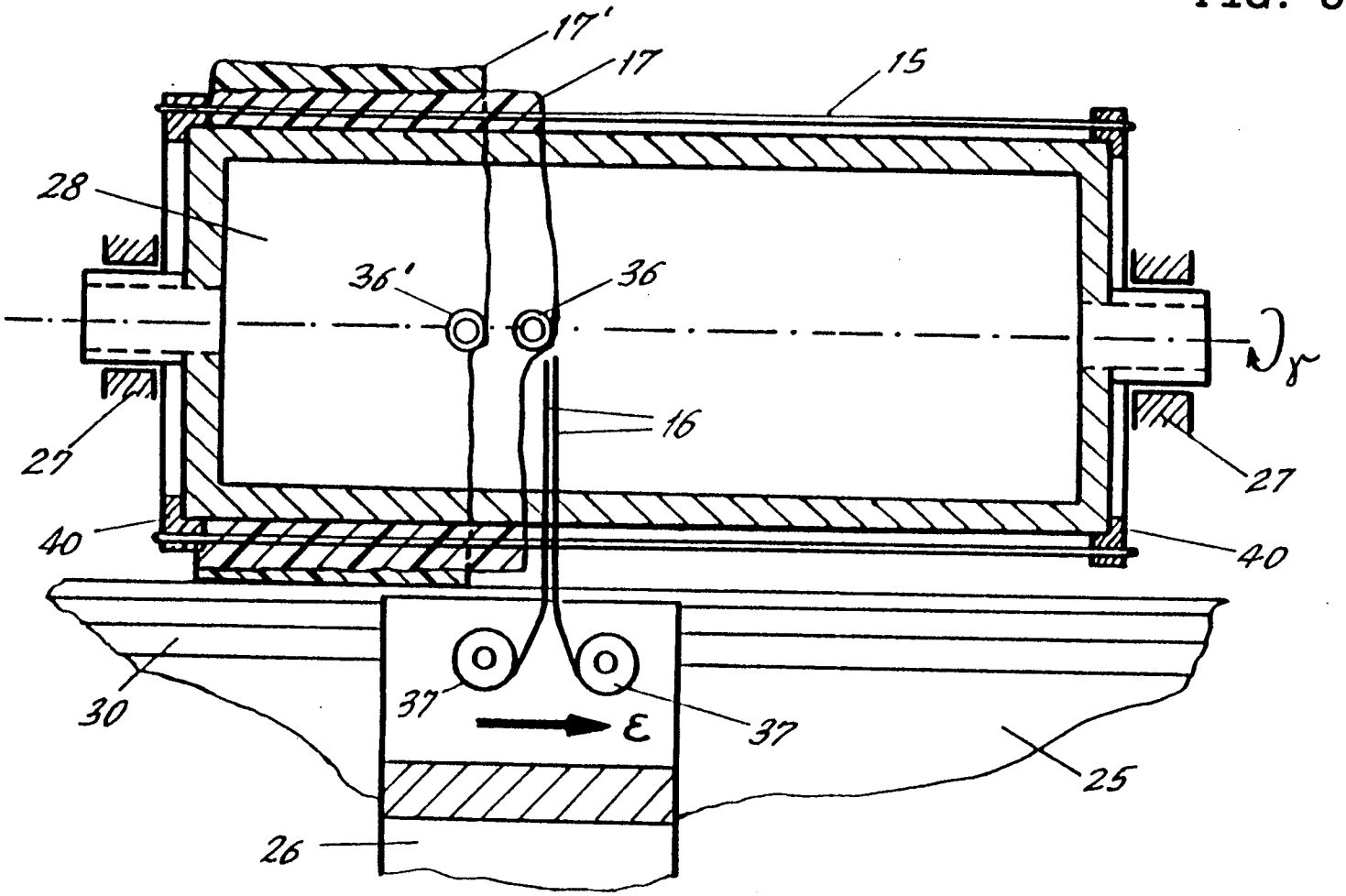

This press unit can, however, according to DE-OS 35 01 635 (corresponding to U.S. Pat. No. 4,625,376) (FIG. 6)

also be a press roll with a loosely arranged press jacket in a so-called matt calendar. A press unit can also be implemented in conjunction with a press jacket shrunk onto a roll.

In connection with the aforementioned press units, known press jackets generally comprise a flexible jacket in which is embedded a so-called reinforcement fabric. This reinforcement fabric comprises so-called peripheral yarns, which extend in the direction of travel of the press jacket and are made of a material with a high modulus of elasticity, and so-called longitudinal yarns, which extend in cross machine direction and which give the press jacket the required stability of shape. The longitudinal and peripheral yarns generally form a textile fabric shell which is initially pre-fabricated in web form and is made endless by joining the web ends, and which is finally cast with the wear-resistant elastomeric material and then fixed thermally.

From U.S. Pat. No. 4,238,287 a press jacket of elastomeric material with embedded yarn-like reinforcements is known. This press jacket exhibits a layer of reinforcement yarns which are enclosed like a sandwich by two layers of yarns running at right angles thereto. To give the press jacket according to U.S. Pat. No. 4,238,287 the required strength, the layers of reinforcement yarns have to be vulcanized together.

The press jackets known until now—apart from the exception to be described below—have one thing in common:

Starting from a flat fabric-like reinforcement insert, which is endless because of the spirally wound peripheral yarns or is made endless by joining the beginning and the end, the press jackets are subjected to successive stages of work:

Pouring of elastomeric material onto one side of the endless reinforcement insert and, if required, smoothing of the resultant surface;

turning of the product formed so far;

pouring of elastomeric material onto the other side of the reinforcement insert, and if required, smoothing of the second surface with possible working-in of grooves and/or holes.

If present, the joint between beginning and end of the fabric jacket forms a certain weak point. Further, the pouring of the elastomeric material in two working steps is problematic, because then the elastomeric material comprises two layers. There is thus the risk that the bond of the two layers (for example because of inclusions) is imperfect and/or not sufficiently permanent. This is particularly the case when the two layers—cf. U.S. Pat. No. 4,238,287—are not held securely together by the reinforcement insert as the reinforcement insert itself is also multi-layer.

The task of the present invention is to improve such a press jacket in such that even during a long service life there is no risk that individual layers will detach from one another. It should, however, continue to be ensured that the reinforcement yarns are completely embedded with the elastomeric material. Furthermore, the press jacket should be capable of being manufactured in a simpler and thus cheaper way without this being associated with qualitative disadvantages.

This task is solved by the following combination of features.

Improvements of the press jacket stated above are as follows. The result has the particular advantages that a material layer which is homogeneous throughout is obtained and the strength of the press shell is defined on the basis of the tension between the longitudinal and peripheral yarns and is reproducibly determinable. Of particular advantage also, the wear of the reinforcement yarns is eliminated and the life of the press jacket (as according to VOITH publication P 4022 K or DE-OS 32 35 468 or U.S. Pat. No. 4,552,620) is not excessively shortened. The material layer of the jacket may also be cast multi-ply.

The process for the manufacture of the known press jackets has already been outlined above. The process is generally expensive and—as already mentioned—also not unproblematic in terms of strength.

DE-OS 18 984 discloses a process for the manufacture of an endless press jacket in which a woven armouring belt is tensioned on a cylinder and the press jacket itself is cast on as an endless jacket in helical form. The armouring belt lies flush with the internal wall of the press jacket and the belt is thus, on the one hand, susceptible to wear and, on the other, destructible externally in that the yarns of the armouring belt can be pulled outwards individually. A complete cross linkage or shrouding of the armouring belt within the elastomeric material does not take place.

The process-specific task underlying the present invention is to indicate a method for the production of a press jacket according to the invention with which, in particular as compared with the method known according to DE-OS 33 18 984, a press jacket can be manufactured which exhibits mainly orthogonally aligned layers of reinforcement yarns which are completely embedded in the jacket material, i.e. which are sufficiently covered with jacket material at the two function surfaces of the press jacket.

This process-specific task is solved by the process steps with the particular advantage that, by pouring in one uniform step, weak points between the individual layers and air inclusions are precluded from the very beginning.

The present invention also provides a device for the manufacture of the press jacket according to the invention or a device for the performance of the process for the production of such a press jacket.

Figure 2A:
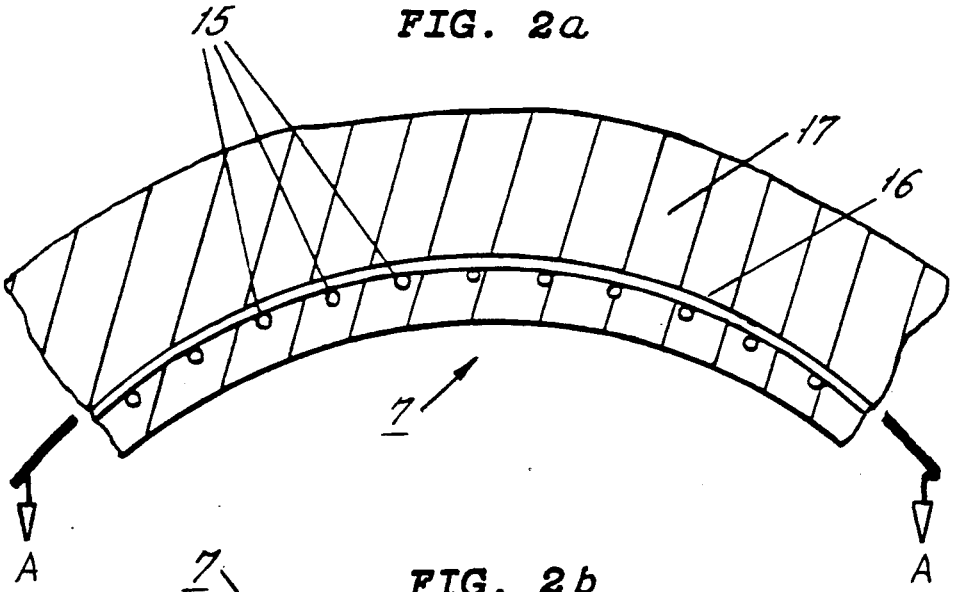
Figure 2B:
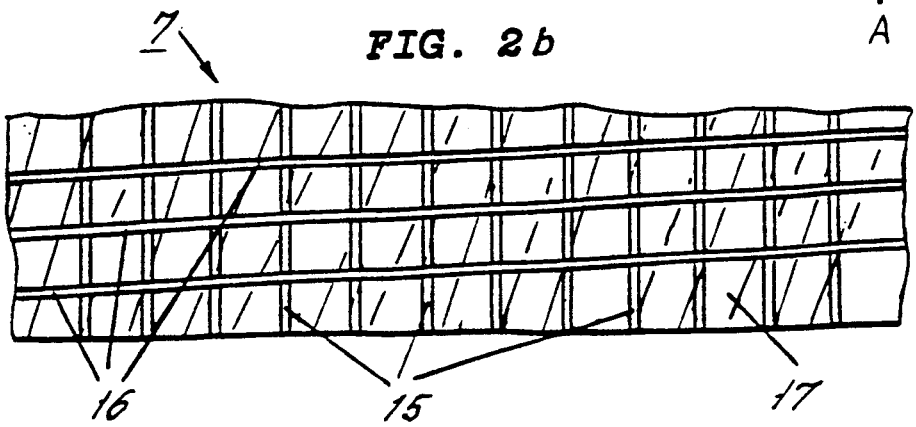
Figure 5:
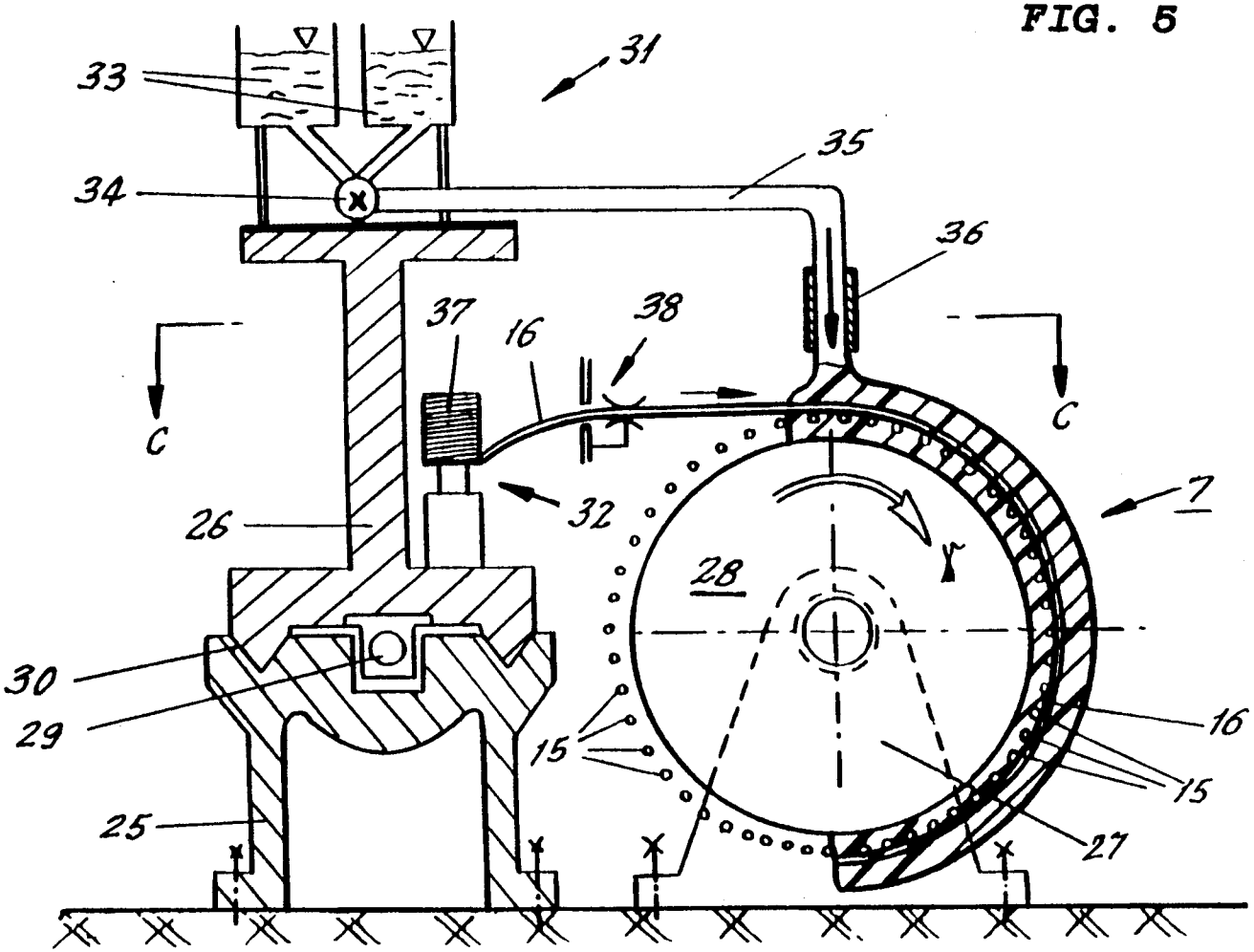
Figure 7A:
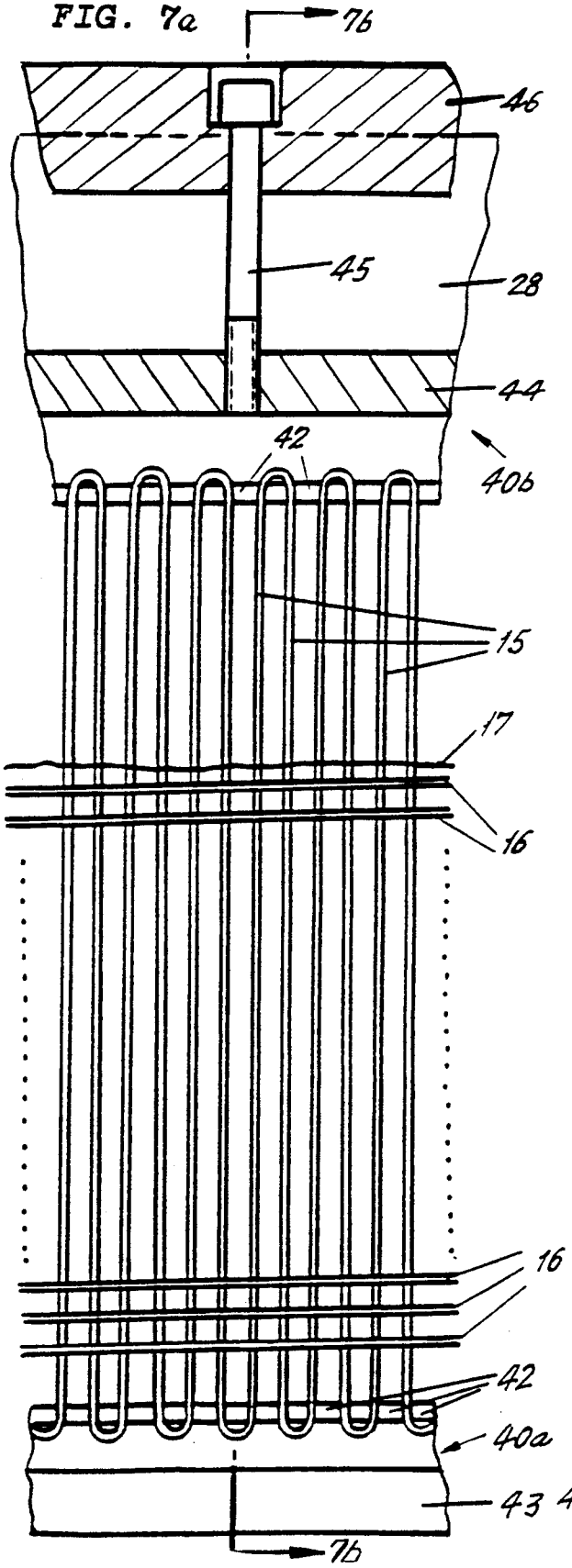
Figure 7B:
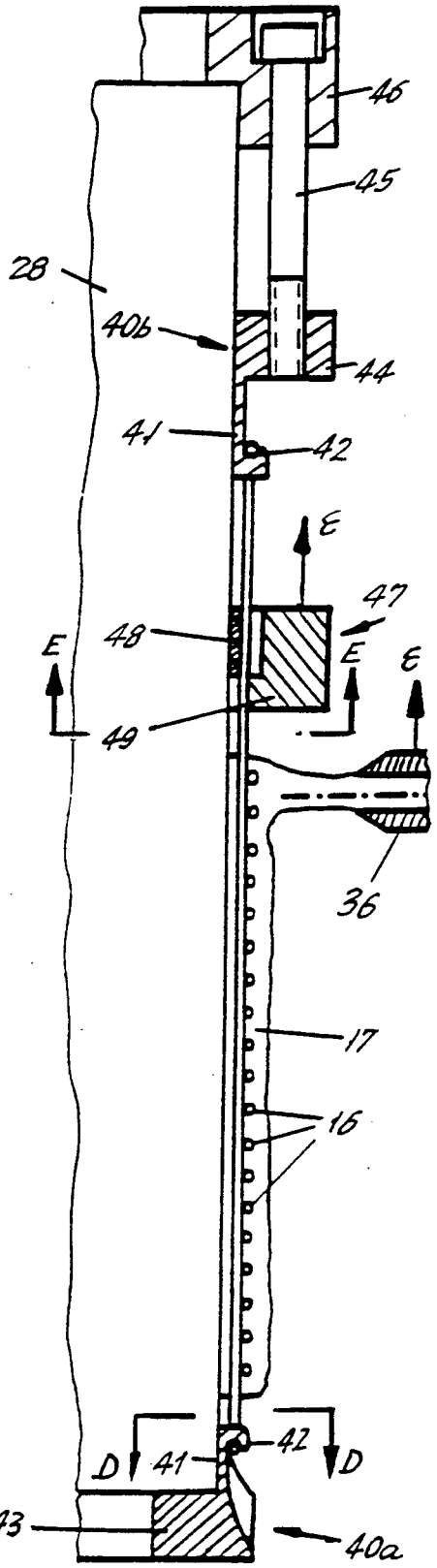

The invention is explained below in greater detail with reference to the drawings. These show in FIG. 1 a portion from a press for the dewatering of paper webs with a press jacket guided via a press shoe;

FIGS. 2*a* and 2*b* a fragment of the structure of the press jacket according to the invention in cross-section and plan view, each in sectionalized representation;

FIG. 3 a fragment of the structure of the press jacket according to the invention, which exhibits peripheral yarns with flat-pressed portions crossed with one another, as well as grooves and blind holes, in sectionalized representation;

FIGS. 4*a* and 4*b* a peripheral yarn of the kind shown in FIG. 3 in detail in two views, one in longitudinal extension and one in sectional representation;

FIG. 5 a sectional representation of a device for the production of a press jacket partly in front view, partly in cross-section;

FIG. 6 a schematic representation of the device for the production of a press jacket in longitudinal section according to line C—C of FIG. 5;

FIGS. 7*a* and 7*b* a fragment of the schematic representation according to FIGS. 4 and 5 with special representation of the inserted longitudinal yarns and or the cast-in peripheral yarns, in two views, i.e. in plan view (FIG. 7*a*) and in longitudinal section (FIG. 7*b*);

FIG. 8 a fragment of the tensioning ring for fixing the longitudinal yarns in sectional representation according to line D—D of FIG. 7*b;*

FIG. 9 a fragment of the longitudinal yarn guide ring in sectional representation according to line E—E of FIG. 7*b;*

FIGS. 10*a* and 10B a schematic representation for explanation of the removal of a finished press jacket from the casting body in the section and namely in two different process stages;

FIG. 11 a fragment of a hollow mould with a shrunk-on polyethylene jacket and holes distributed around the circumference in sectionalized representation.

Figure 1:
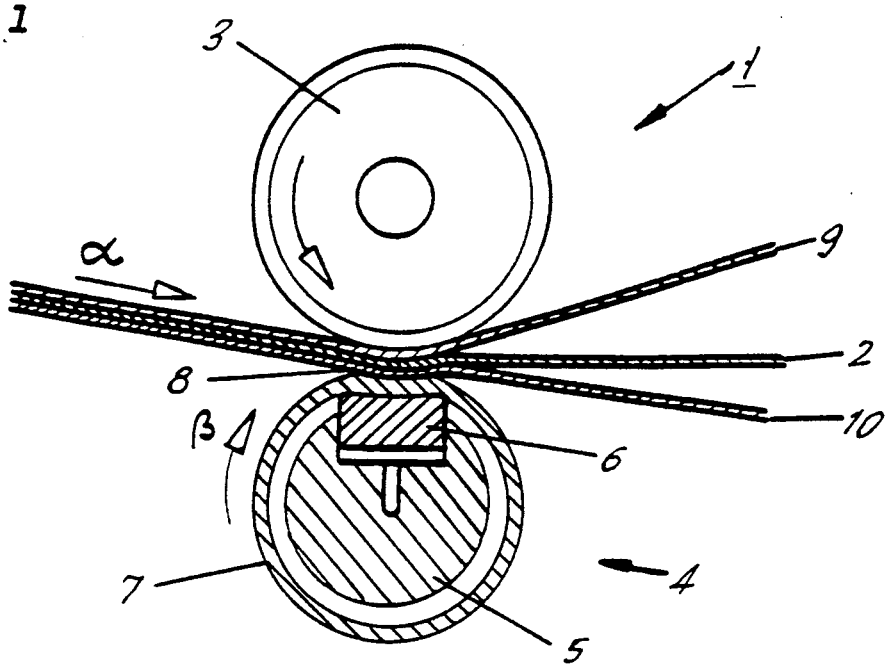

FIG. 1 shows, without framing—a fragment of a press 1 for dewatering a (continuously) running paper web 2. This press 1 consists essentially of a top roll 3 and a bottom roll 4. The bottom roll includes a stationary core 5 in which is guided a press shoe 6 which is pressed hydraulically against the top roll 3. The stationary core 5 and the hydraulically supported pressure shoe 6 of the bottom roll 4 are surrounded by an endless (tubular) flexible press jacket 7, which comprises an elastomeric material with embedded reinforcement yarns.

This press jacket 7 slides with its smooth internal surface over the pressure shoe 6. Together with the top roll 3, they form an extended press nip 8 (extended-nip press). The outside of the pressure shoe 6 is concavely shaped to complement the diameter of the top roll 3, i.e., the pressure shoe 6 has a cavity generally corresponding to the diameter of the top roll 3 in its sliding surface.

To decrease friction between the pressure shoe 6 and the press jacket 7, a unit not shown, is provided for wetting the inner side of the press jacket 7 with lubricant.

The paper web 2 is fed between two so-called dewatering felts 9, 10 to the said press nip 8 (arrow a). Due to the friction between the dewatering felt 10 sliding over the pressure shoe 6, the press jacket 7 is moved over the pressure shoe 6 (arrow b). The surface of the press jacket 7 may also be suitable to absorb water from the press felt 10, namely water which was removed in the press nip 8 from the paper web 2.

The press jacket of the invention is also applicable, for example, in a calender of a papermaking machine. In this case, however, the outer surface of the press jacket must then have a smooth and even a structure as possible.

Irrespective of the applications in papermaking machines, however, other application for such a press jacket are also conceivable.

In the following sections the press jacket 7 per se, as well as its manufacture, are explained in detail.

FIGS. 2*a* and 2*b* show the structure of the press jacket 7, in cross-section (FIG. 2*a*) (analogous with the representation according to FIG. 1) and in an elevation (FIG. 2*b*) on a press jacket 7 cut open down to the level of the reinforcement yarns. FIG. 2*a* shows a cast press jacket 7 with a smooth interior surface and a still unmachined external surface. The thickness of the press jacket 7 has been selected according to the application, with, for example, very thick press jackets 7 also being capable of being manufactured by a two-layer or also multi-layer of cast jacket material 17. The press jacket 7 according to FIG. 2*a* includes at a constant radial distance of preferably 1 to 3 mm from the inside and at a constant circumferential distance from each other a large number of longitudinal yarns 15 distributed evenly around the circumference. These form the inner layer of the reinforcement yarns and give the press jacket the required stability of shape viewed across the width of the press nip. The distance from the inside of the press jacket 7 must be sufficiently large with regard to the wear layer; it must, however, also be so small that the required flexibility remains ensured.

At the outward side of these longitudinal yarns 15 facing away from the inside of the press jacket 7 peripheral yarns 16 are provided. They represent the second layer of reinforcement yarns. This layer of peripheral yarns 16 is formed by winding of a yarn (or even several yarns) along a helical line on the longitudinal yarns 15 and the layer lies with pre-tension on the longitudinal yarns 15. This pre-tension must of course not be so great that the longitudinal yarns 15 are deflected out too close to the inner wall of the press jacket 7.

The reinforcement inserts comprising longitudinal and peripheral yarns are always embedded in a uniform layer of the jacket material 17 to achieve a thoroughly homogeneous shrouding.

FIG. 2*b* is a drawing of the fragment according to FIG. 2*a* in sectional representation along the sectional line A—A. This section A—A in FIG. 2*a* runs along the "top side" or outward of the peripheral yarns 16. The longitudinal yarns 15 are aligned parallel to one another at a constant distance. The peripheral yarns 16 also lie parallel and equidistant from one another, but in accordance with the manufacturing process still to be described, they are at an angle to the outer edge of the press jacket 7. The longitudinal yarns 15 run at least approximately parallel to the axis of the jacket (see FIG. 7*b*).

FIG. 3 shows a further embodiment for the inner structure and design of the press jacket 7. A longitudinal yarn 15 runs parallel to the inner wall of the press jacket 7. At right angles to this, i.e. normal to the drawing plane, a large number of peripheral yarns 16 rest equidistant on the longitudinal yarn 15. These peripheral yarns 16 comprise successive flat-pressed portions, which cross each other alternately by 90°. (See FIGS. 4*a* and 4*b*).

In accordance with the special application as per FIG. 1, there are depressions in the jacket material 17 from the outside of the press jacket 7, such as blind holes 18 and/or grooves 19 running in peripheral direction (i.e. parallel to the peripheral yarns 16).

These blind holes 18 have a diameter of approx. 2 to 3 mm and a depth of approx. 2 to 10 mm. The percentage of area relative to the entire outer area of the press jacket 7 should be approx. 15 to 30%.

The grooves 19 worked in additionally or even alternatively to the blind holes 18 have a width of approx. 0.4 to 0.8 mm, and they have a depth of approx. 1 to 3 mm.

The important thing with regard to these blind holes and the grooves is that the reinforcement yarns are not damaged so that press water cannot destroy the interior of the jacket.

FIG. 4 shows, in two elevations, a peripheral yarn 16 of the special kind used in the example according to FIG. 3, once in longitudinal extension (FIG. 4*a*) and once in section B—B (FIG. 4*b*). This peripheral yarn 16 comprises alternately successive, flat-pressed yarn portions 20 which cross each other in such a way that a sequence of perpendicularly aligned portions results. Through this special disposition of the peripheral yarns 16 a much better form fit between the peripheral yarns 16 and the jacket material in the cast press jacket 7 is achieved. In this way the yarns are optimally fixed and the press jacket 7 is given an optimum stability of shape and dimension.

In general, this form fit is all the better the more irregularly the peripheral yarns 16 are shaped along their extension. Cross-sectional changes in general, equidistant flattened portions with remaining round cross-sections therebetween the alternating, angularly offset flattened portions according to the example as per FIG. 4 ensure a good form fit between the reinforcement yarns and the jacket material. Depending on the concept, the peripheral yarns, the longitudinal yarns or even both types of longitudinal yarns can be provided jointly with cross-sectional changes of the aforementioned kind.

The reinforcement yarns themselves are so-called monofilaments, i.e. non-twisted yarns, or they each comprise 2 to 6 monofilament single yarns entwisted with one another. In special development the one kind of reinforcement yarns may be monofilament and the other kind twisted. With the monofilament yarns, air inclusions and mutual friction of the yarns are avoided a priori. But also with the reinforcement yarns twisted form 2 to 6 monofilament yarns the interstices are so large that the jacket material can penetrate well and deep.

The reinforcement yarns are made of polyamide or polyester because of strength and processing characteristics, and namely in particular in the constellation that the longitudinal yarns—with a view to elasticity—are of polyamide and the peripheral yarns—with a view to elasticity—are of polyamide and the peripheral yarns—with a view to dimensional stability—of polyester. Polyurethane is preferably selected as elastomeric jacket material owing to its high wear strength.

The production of a press jacket 7 of the kind described in the previous sections is explained in detail in the following on the basis of the device for its manufacture.

FIG. 5 shows a basic representation of the entire device. This entire device consists of two functionally matched basic units, a support 26 running longitudinally on a stationary machine table 25 and a casting body 28 rotatably mounted in stationary bearing shields 27. The casting body is designed in the illustrated example as a hollow cylinder which is turned about its axis via a not shown drive means, with these rotary drive means the translatoy drive means indicated by a spindle drive 29 for the support 26 being coordinated with each other. A certain angle of rotation of the casting body 28 corresponds to a certain stroke distance of the support 26.

This support 26, which can, for example, be moved via spindle drive 29 normal to the plane of projection in the guide rails 30 carries, in accordance with the representation according to FIG. 5, on the one hand unit 31 for the preparation and supply of the elastomeric castable jacket material and, on the other hand, a unit 32 for delivery of the peripheral yarn 16 (or the peripheral yarns).

Unit 31 for the preparation and supply of the jacket material comprises two storage tanks 33 for the commponents of the jacket material, a mixer 34 for these components, a supply line 35 and a casting nozzle 36 for deliver of the jacket material to the surface of the casting body 28. The said elements of unit 31 are provided with a mechanically rigid connection to the support 26 and are consequently translated with this. The casting nozzle 36 is then preferably positioned so that it is located above the casting body 28, and namely preferably displaced somewhat laterally.

The unit 32 for the deliver of (at least one) peripheral yarn 16 comprises one (or several) yarn roller(s) 37 from which the peripheral yarn 16 can be pulled off. This yarn roller 37 is also firmly connected to the support 26. Arranged on the course of the peripheral yarn 16 between yarn roller 37 and casting body 28 is a guiding device 38 for the peripheral yarn(s) 16. In this guiding device 38 the peripheral yarns 16 lying beside one another are positioned axially at the correct distance from one another.

The system described so far is now explained on the basis of its operation in conjunction with the manufacture of a press jacket 7.

Prior to start-up of the system shown in FIG. 5, the casting body 28 is first prepared as longitudinal yarns 15 are stretched around the entire periphery distributed at equal circumferential distances and each at an equal radial distance from the surface of the casting body 28. These longitudinal yarns 15 lie parallel to one another and thus form a coaxial cage arrangement over the periphery of the casting body 28.

At an end face of the casting body 28 the beginning of the peripheral yarn 16 is then fixed.

Now the casting body 28 is turned (arrow w). At the same time the casting nozzle 36 is opened and the support 26 is moved linearly. The elastomeric jacket material 17 flows onto the surface of the casting body 28 with the tensioned longitudinal yarns 15 and forms a coaxial press jacket layer on the casting body 28. With the turning of the casting body 28 the peripheral yarn 16 is now simultaneously wound up preferably under a certain pre-tension. This pre-tension is calculated so that the peripheral yarn 16 rests stretched on the longitudinal yarns 15 and even deflects these lightly towards the surface of the casting body 28.

As mentioned above, with the turning of the casting body 28 and the pouring-on of the jacket material 17 the support 26 is simultaneously moved linearly. In this way the jacket is developed in the form of a helically wound rope of liquid material 17. Simultaneously, the peripheral yarn 16 is wound up in the form of a helical line on the cage arrangement formed by the longitudinal yarns 15. The peripheral yarn is introduced into the still liquid material 17 and is fixed therein with the curing of the jacket material 17.

As shown in the representation according to FIG. 5, one half of the first turn of the jacket material 17 is cast. This initial part of the press jacket 7 is closed by the continuation of the casting process and of the winding process for the peripheral yarn 16 and continued over the length of the casting body 28—up to its second end.

FIG. 6 shows a schematic representation of the system drawn in FIG. 5 in plan view and namely in section C—C according to FIG. 5.

On the turning (arrow w) casting body 28 mounted in the bearing plates 27 are tensioned the longitudinal yarns 15 and namely—in the illustrated simplest case—over tensioning rings 40 supported at the end faces of the casting body 28. Parallel to the axis of the casting body 28 the support 26 is moved in the guide rails 30 (arrow s). The support 26 carries two yarn rollers 37 for the unwinding of two peripheral yarns 16 as well as a casting nozzle 36.

With simultaneous rotary movement of the casting body 28 and translatory (axis-parallel) movement of the support 26, a layer of elastomeric jacket material 17 is thus cast on in the form of a helical line. Into this layer 17 the peripheral yarns 16 are wound in simultaneously, and they are likewise pulled in the form of a helical line over the longitudinal yarns 15.

In FIG. 6 approximately one third of a press jacket 7 is finish-cast.

The representation as per FIG. 6 additionally shows a further embodiment of the invention. For certain applications press jackets of greater thicknesses are required. Such material thicknesses, however, can in general not be produced by means of a single casting nozzle 36.

FIG. 6 shows a second casting nozzle 36' to solve this problem, which is likewise rigidly connected to the support 26 and thus is moved synchronously, while lagging the (first) casting nozzle 36 along the casting body 28. With this second casting nozzle 36' a second layer of jacket material 17' can thus be cast on. The essential thing is that the armouring of the press jacket 7 comprising longitudinal yarns 15 and peripheral yarns 16 is wholly and completely embedded in the first layer of jacket material 17 so that a complete connection between the jacket material and the reinforcement yarns is guaranteed.

FIG. 7 shows a fragment of the surface of the casting body 28 in two views (FIG. 7*a* and FIG. 7*b*).

In FIG. 7*a* the arrangement and allocation of the longitudinal yarns 15 is shown. Which are pulled back and forth in a meandering way between two tensioning rings 40*a*/40*b* along the jacket of the casting body 28. Each of the tensioning rings 40*a*/40*b* comprising a packing-collar-shaped ring 41, which has projections 42 over the periphery. These projections 42 determine the distance of the longitudinal yarns 15 between one another and their distance from the surface of the casting body 28. The bottom end-face tensioning ring 40*a* on the drawing has a flange shoulder 43 on which this tensioning ring 40*a* rests at the end face of the casting body 28. The top, second tensioning ring 40*b* sits loosely on the casting body 28 and is connected with a ring-like projection 44 directed radially outwards, which in turn can be tensioned by means of a screw connection 45 and a flange 46 supported at the second end face of the casting body 28.

For insertion of the longitudinal yarn 15 and for suspension at the projections 42 of the two tensioning rings 40*a/b* the said screw connection 42 is loose. If the longitudinal yarns 15 are suspended in the projections 42 over the entire surface of the casting body 28 and these yarn lines thus form a closed cage between the tensioning rings 40*a/b*, the loose tensioning ring 40*b* on the casting body 28 is pulled towards the end face via the screw connection 45. In this way the longitudinal yarns 15 are tensioned.

In view of the peripheral yarns 16 pulled up over the longitudinal yarns 15, which do after all run in helical lines shape, i.e. inclined in FIG. 7, it is conceivable to twist the two tensioning rings 40*a/b* each against the other until the longitudinal yarns 15 also run at an angle and then form an orthogonal grid pattern with the peripheral yarns 16.

The side view of FIG. 7, i.e. FIG. 7*b* shows that the casting nozzle 36 has already progressed over more than half the width of the press jacket 7 to be manufactured along the surface of the casting body 28. Up to that point the peripheral yarn 16 is pulled in the form of a spiral into the jacket material 17 and onto the longitudinal yarns 15.

To avoid with certainty that the longitudinal yarns 15 are pressed onto the casting body 28 possibly during casting on of the jacket material 17 or during pulling on of the peripheral yarn 16, i.e. to ensure the radial distance of the longitudinal yarns 15 from the casting body 28, a longitudinal yarn guide ring unit 47 is provided, which is moved ahead of the casting nozzle 36 (arrow s) and synchronously with it.

This longitudinal yarn guide ring unit 47 comprises a spacer retaining ring 48, which rests between the surface of the casting body 28 and the longitudinal yarns 15, and a comb-like ring 49 which has grooves corresponding to the distance of the longitudinal yarns 15 from each other. This longitudinal yarn guide ring unit 47 comprising the spacer retaining ring 48 and the comb-like ring 49 is connected to the support 26 via a guiding device not shown.

With this longitudinal yarn guide ring unit 47 the longitudinal yarns 15 are therefore aligned around the entire periphery of the casting body 28. The pouring jet of the jacket material 17 coming out of the casting nozzle 36 thus fixes these longitudinal yarns 15 in their correct position and alignment. For clarity, it is noted that the longitudinal yarn guide ring unit 47 performs a linear movement relative to the casting body 28 and turns together with the casting body 28.

In FIG. 8 is represented in conformity with section line D—D according to FIG. 7*b* an extract of the (bottom) tensioning ring 40*a*. This representation shows the collar-like ring 41 which rests on the shell of the casting body 28 and has a series of projections 42 spread around the periphery, between each of which there is a groove. The longitudinal yarns 15 are pulled through these grooves, which are wrapped around each second projection 42.

Shown in FIG. 9 is in accordance with section line E—E according to FIG. 7*b* an extract of the longitudinal yarn guide ring unit 47. This comprises the spacer retaining ring 48 which rests on the surface of the casting body 28 and supports the longitudinal yarns 15, and maintains their distance from the casting body. The spacer retaining ring 48 precedes the comb-like ring 49 which has grooves 50 corresponding to the distance between the longitudinal yarns 15, by means of which the comb-like ring 49 is placed via the longitudinal yarns 15 on the casting body 28.

The comb-like ring 49 is made in multiple sections, with the parts being connectable with one another by means of screw connections 51. This makes it possible to mount the ring 49 after tensioning the longitudinal yarns 15.

With regard to the design of the longitudinal yarn guide ring unit 47 it is also conceivable to provide the spacer retaining ring 48 with a flange and with grooves therein corresponding to the longitudinal yarns 15 and to insert the longitudinal yarns 15 into the spacer retaining ring while they are being drawn in.

On the basis of the process steps shown in FIGS. 10*a* and 10*b* the removal of a finish-cast press jacket 7 is explained.

A clamping ring is fitted to each of the two end areas of the press jacket 7. One clamping ring 53 is firmly connected to the press jacket 7 and dimensioned compared with the casting body 28 so that it can be pulled longitudinally with the press jacket 7, but seals the gap between the press jacket 7 and the casting body 28 as well. The second clamping ring 54 is designed so that it remains stationary in place relative to the casting body 28 and makes possible a slipping or pulling through of the press jacket 7. The second clamping ring 54, too, is intended to press the press jacket 7 as close as possible to the casing body 28. (FIG. 10*a*)

If a fluid is now pressed into the area of the parting surface between press jacket 7 and casting body 28 through a supply pipe 55 passing through the casting body 28 or its wall, this fluid spreads out over this parting surface in the nature of an air cushion and the press jacket 7 can be pulled off by means of a pull ring 56. The first clamping ring 53 moves together with the press jacket 7 along the casting body 28 until it makes contact at the second clamping ring 54 and the press jacket 7 is fully free. This pulling off is made easier by the fact that the casting body 28 is coated with an adherence-reducing material before casting of the jacket material. (FIG. 10*b*).

According to FIG. 11 a further possibility for pulling off a press jacket 7 cast onto a casting body 29 is conceivable.

The casting body 28 is a hollow cylinder. Before casting on of the jacket material 17 a polyethylene jacket 57 is shrunk onto this hollow cylinder. If a fluid is now pressed into holes 58 in the wall of the hollow cylinder, a sliding layer forms in the parting surface between casting body 28 and polyethylene jacket 57 and the press jacket 7 can be pulled off together with the polyethylene jacket 57.

In principle it is also conceivable to coat the casting body 28 with a material preventing adherence of the jacket material and then expanding from the inside and pulling off the press jacket 7 by heat treatment from outside or through holes in a hollow cylindrical casting body.

Finally, a press jacket manufactured with the above-described method and the device for preforming this method, is relatively inexpensive to manufacture, since the working steps of weaving, making endless and thermo-fixing of a fabric are not necessary and since, in principle, a stable press jacket is achievable with a single casting operation. Especially due to the fact that a turning of the finished press jacket is dispensable, relatively thick jackets—possibly also by means of multilayer casting—can be made. Particularly important in this connection is that the armouring, i.e. the reinforcement lies securely inside the press jacket and is thus protected against wear and destruction.

The surface, i.e. outer surface of the press jacket must be machined after casting. On the one hand, especially in view of use in a matt calendar, the surface must be ground cylindrically smooth, and on the other—cf. FIG. 3—the blind holes and grooves must be machined in for taking up the water for use in a dewatering press. As far as the inside of the press jacket is concerned, it can remain unmachined.

I claim:

1. An endless pres jacket for us in a dewatering press for web-like material, wherein the press jacket has an advancing direction of travel and a width at a right angle to the direction of travel;

the press jacket is comprised of elastomeric jacket material;

two layers of reinforcing yarns arranged radially one above the other are embedded in the jacket material; a first one of the layers is an internal layer comprised of longitudinal extending yarns, which extend generally at right angles to the direction of travel of the press jacket and along the complete width of the press jacket; a second one of the layers is an external layer comprised of reinforcing peripheral yarns extending mainly in the peripheral direction along the direction of travel of the jacket, and the peripheral yarns are arranged in the form of at least one helical line around the press jacket; and the elastomeric material layer encases the reinforcement yarns on all sides, and is manufactured from a single casting cured by homogeneous cross-linkage.

2. The press jacket of claim 1, wherein the peripheral yarns are pretensioned and rest with pretension on the longitudinal yarns in the jacket.

3. The press jacket of claim 2, wherein the longitudinal yarns are arranged at a radial distance form the radial inside of the press jacket and the longitudinal yarns are arranged generally parallel to one another, while the peripheral yarns are arranged slightly outward of the longitudinal yarns.

4. The press jacket of claim 3, wherein the press jacket has a radially inner wall and the longitudinal yarns are arranged at a distance of 1 to 3 mm from the inner wall of the press jacket.

5. The press jacket of claim 1, wherein at least some of the reinforcement yarns are monofilament.

6. The press jacket of claim 1, further comprising the press jacket having a radially outer wall and depressions defined in the jacket from the outer wall thereof.

7. The press jacket of claim 6, wherein the depressions in the outer wall of the jacket comprise grooves in the jacket outer wall mainly running in the peripheral travel direction of the jacket.

8. An endless press jacket for use in a dewatering press for web-like material, wherein the press jacket has an advancing direction of travel and a width at a right angle to the direction of travel;

the press jacket is comprised of elastomeric jacket material;

two layers of reinforcing yarns arranged radially one above the other are embedded in the jacket material; a first one of the layers is an internal layer comprised of longitudinal extending yarns which extend generally at right angles to the direction of travel of the press jacket and along the complete width of the press jacket; a second one of the layers is an external layer comprised of reinforcing peripheral yarns extending mainly in the peripheral direction along the direction of travel of the jacket, and the peripheral yarns are arranged in the form of at least one helical line around the press jacket; and the elastomeric material layer encases the reinforcement yarns on all sides, and is manufactured from a single casting cured by homogeneous cross-linkage, at least some of the reinforcing yarns being comprised of a plurality of monofilament yarns which are twisted together to define the respective reinforcement yarns.

9. An endless press jacket for use in a dewatering press for web-like material, wherein the press jacket has an advancing direction of travel and a width at a right angle to the direction of travel;

the press jacket is comprised of elastomeric jacket material;

two layers of reinforcing yarns arranged radially one above the other are embedded in the jacket material; a first one of the layers is an internal layer comprised of longitudinal extending yarns which extend generally at right angles to the direction of travel of the press jacket and along the complete width of the press jacket; a second one of the layers is an external layer comprised of reinforcing peripheral yarns extending mainly in the peripheral direction along the direction of travel of the jacket, and the peripheral yarns are arranged in the form of at least one helical line around the press jacket; and the elastomeric material layer encases the reinforcement yarns on all sides, and is manufactured from a single casting cured by homogeneous cross-linkage;

the press jacket has a radically outer wall with depressions defined in the press jacket from the outer wall thereof, the depression comprising blind holes in the outer wall of the jacket.

10. The press jacket of claim 9, wherein the blind holes have a diameter in the range of approximately 2 to 3 mm, a depth in the range of approximately 2 to 10 mm and the blind holes are arranged at a spacing form one another around the jacket so that the proportion of the area of the entire outer wall of the jacket occupied by the holes is approximately in the range of 15 to 30%.

11. The press jacket of claim 9, wherein the depressions further comprise grooves defined in the outer wall of the press jacket in addition to the blind holes, the grooves each having a width approximately in the range of 0.4 to 0.8 mm and having a depth approximately in the range of 1 to 3 mm.

12. An endless press jacket for use in a dewatering press for web-like material, wherein the press jacket has an advancing direction of travel and a width at a right angle to the direction of travel;

the press jacket is comprised of elastomeric jacket material;

two layers of reinforcing yarns arranged radially one above the other are embedded in the jacket material; a first one of the layers is an internal layer comprised of longitudinal extending yarns which extend generally at right angles to the direction of travel of the press jacket and along the complete width of the press jacket; a second one of the layers is an external layer comprised of reinforcing peripheral yarns extending mainly in the peripheral direction along the direction of travel of the jacket, and the peripheral yarns are arranged in the form of at least one helical line around the press jacket; and the elastomeric material layer encases the reinforcement yarns on all sides, and is manufactured from a single casting cured by homogeneous cross-linkage;

the reinforcing yarns being selected from the group consisting of polyamide and polyester.

13. The press jacket of claim 12, wherein the longitudinal yarns are comprised of polyamide and the peripheral yarns are comprised of polyester.

14. An endless press jacket for use in a dewatering press for web-like material, wherein the press jacket has an advancing direction of travel and a width at a right angle to the direction of travel;

the press jacket is comprised of elastomeric jacket material;

two layers of reinforcing yarns arranged radially one above the other are embedded in the jacket material; a first one of the layers is an internal layer comprised of longitudinal extending yarns which extend generally at right angles to the direction of travel of the press jacket and along the complete width of the press jacket; a second one of the layers is an external layer comprised of reinforcing peripheral yarns extending mainly in the peripheral direction along the direction of travel of the jacket, and the peripheral yarns are arranged in the form of at least one helical line around the press jacket; and the elastomeric material layer encases the reinforcement yarns on all sides, and is manufactured from a single casting cured by homogeneous cross-linkage, at least one of the longitudinal and the peripheral yarns having a changing cross-section over its length.

15. The press jacket of claim 14, wherein the change in cross-section comprises an alternating change in shape between round and flat pressed yarn portions.

16. The press jacket of claim 14, wherein the cross-sectional shape includes flap pressed yarn portions at the intersection with other yarns.

17. An endless press jacket for use in a dewatering press for web-like material, wherein the press jacket has an advancing direction of travel and a width at a right angle to the direction of travel;

the press jacket is comprised of elastomeric jacket material of polyurethane;

two layers of reinforcing yarns arranged radially one above the other are embedded in the jacket material; a first one of the layers is an internal layer comprised of longitudinal extending yarns which extend generally at right angles to the direction of travel of the press jacket and along the complete width of the press jacket; a second one of the layers is an external layer comprised of reinforcing peripheral yarns extending mainly in the peripheral direction along the direction of travel of the jacket, and the peripheral yarns are arranged in the form of at least one helical line around the press jacket; and the elastomeric material layer encases the reinforcement yarns on all sides, and is manufactured from a single casting cured by homogeneous cross-linkage.

18. An endless press jacket for use in a dewatering press for web-like material, wherein the press jacket has an advancing direction of travel and a width at a right angle to the direction of travel;

the press jacket is comprised of elastomeric jacket material;

two layers of reinforcing yarns arranged radially one above the other are embedded in the jacket material; a first one of the layers is an internal layer comprised of longitudinal extending yarns which extend generally at right angles to the direction of travel of the press jacket and along the complete width of the press jacket; a second one of the layers is an external layer comprised of reinforcing peripheral yarns extending mainly in the peripheral direction along the direction of travel of the jacket, and the peripheral yarns are arranged in the form of at least one helical line around the press jacket; and the elastomeric material layer encases the reinforcement yarns on all sides, and comprises a first radially internal jacket layer which completely encloses the reinforcing yarns and a second radially outer layer cast prior to curing of the inner layer which is radially outside the inner layer, the first and second layers being cured by homogeneous cross-linkage.

* * * * *